United States Patent [19]

Baron

[11] Patent Number: 4,627,486

[45] Date of Patent: Dec. 9, 1986

[54] CORRECTION FOR TUBE SHEET MISALIGNMENT IN HEAT EXCHANGERS HAVING TUBE CLEANING ARRANGEMENTS THEREIN

[75] Inventor: Walter J. Baron, Mequon, Wis.

[73] Assignee: Water Services of America, Inc., Milwaukee, Wis.

[21] Appl. No.: 738,430

[22] Filed: May 28, 1985

[51] Int. Cl.[4] ..... F28G 1/12

[52] U.S. Cl. ..... 165/81; 165/95; 15/3.51

[58] Field of Search ..... 15/3.51; 165/81, 82, 165/95, 158, 173, 175, 178

[56] References Cited

U.S. PATENT DOCUMENTS

| | | | |
|---|---|---|---|
| 2,152,266 | 3/1939 | McNeal | 165/70 X |
| 2,660,411 | 11/1953 | Weber | 165/70 |
| 4,083,707 | 4/1978 | Biuins, Jr. | 165/158 X |
| 4,124,065 | 11/1978 | Leitner et al. | 165/95 |
| 4,398,592 | 8/1983 | Baron et al. | 165/95 |

FOREIGN PATENT DOCUMENTS

| | | | |
|---|---|---|---|
| 24196 | 2/1984 | Japan | 165/95 |

*Primary Examiner*—William R. Cline

*Attorney, Agent, or Firm*—Andrus, Sceales, Starke & Sawall

[57] ABSTRACT

A heat exchanger having end head elements has a plurality of fluid flow tubes secured adjacent their ends by tube sheet elements. Cleaning devices are adapted to shuttle back and forth in the tubes and are adapted to be captured by basket elements. A basket retaining plate is disposed outwardly of and parallel to a tube sheet element. A longitudinally compressible device is disposed between the retaining plate and at least one of the elements to compensate for misalignment of a tube sheet relative to the heat exchanger housing.

9 Claims, 8 Drawing Figures

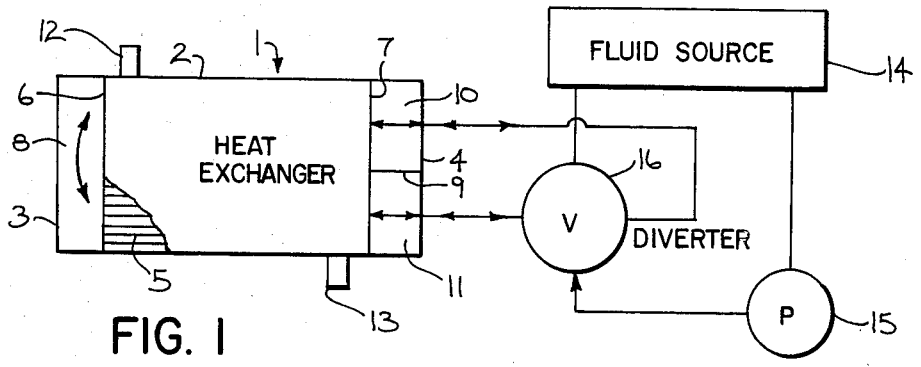
FIG. 1
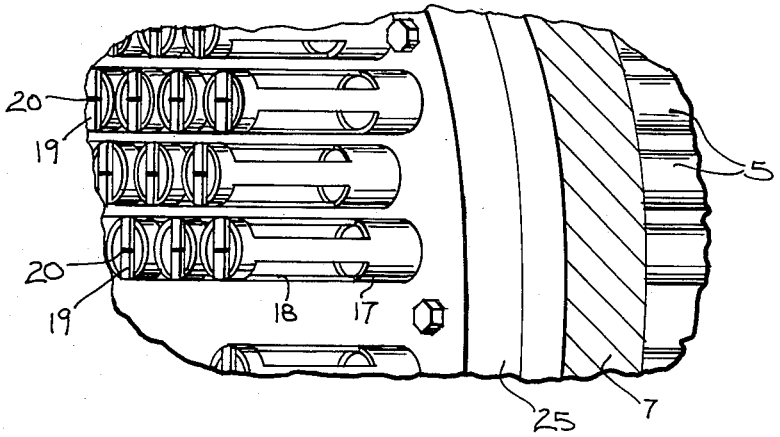
FIG. 2
PRIOR ART
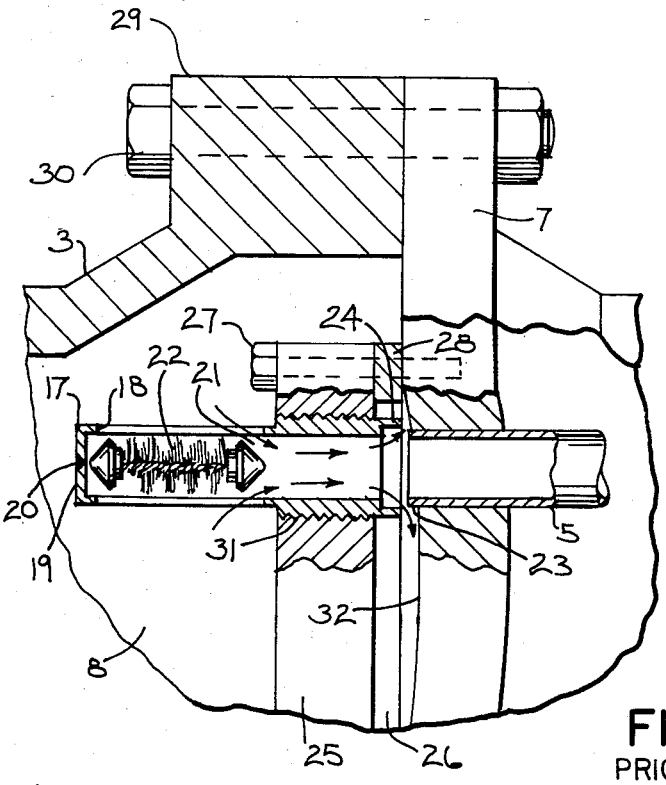
FIG. 3
PRIOR ART
FIG. 6
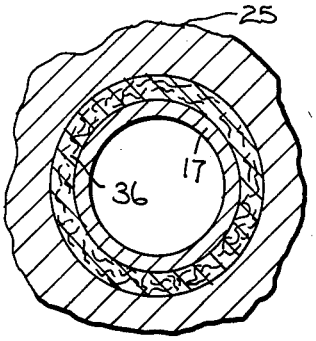

CORRECTION FOR TUBE SHEET MISALIGNMENT IN HEAT EXCHANGERS HAVING TUBE CLEANING ARRANGEMENTS THEREIN

U.S. PRIOR ART OF INTEREST

| U.S. Pat. No. | Inventor | Issued |
|---|---|---|
| 4,124,065 | Leitner et al | November 7, 1978 |
| 4,398,592 | Baron et al | August 16, 1983 |

BACKGROUND AND SUMMARY OF THE INVENTION

This invention relates to shuttle cleaning of heat exchanger tubes and is an improvement over the concepts disclosed in the above-identified patents.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements, such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

Several ways have been suggested to mount the baskets in fluid flow communication with the tubes, which enter openings in the tube sheets. The inner basket ends have been press fit into the openings or into the tube ends themselves.

In other arrangements, the inner basket ends are provided with a collar which hangs from a flared lip on the tube end which is disposed beyond the outer tube sheet face.

In yet a further arrangement, such as in an embodiment disclosed in the above-identified U.S. Pat. No. 4,398,592, a retaining plate is disposed outwardly of and generally parallel to the tube sheet and cooperates with the tube sheet and the tube ends to hold the baskets in place.

It has been observed that with the latter construction there may not be proper sealing action between the various elements so that undesirable fluid leakage occurs within the system. This problem has been found to be caused by misalignment of the tube sheet relative to the heat exchanger shell, such as may be due to the heat of welding the tube sheet to the shell. As a result, the baskets and retaining plate were not properly positioned, resulting in the said undesirable fluid leakage.

It is a task of the present invention to correct for misalignment of a heat exchanger tube sheet so that there is a proper seal between the cooperative elements, including the tube sheet, tubes, baskets and retaining plate. It is a further task to correct for the misalignment in a simple low-cost but yet effective manner.

In accordance with the various aspects of the invention, longitudinally compressible means are disposed between the retaining plate and/or basket and their associated elements. In one embodiment, the compressible means is disposed between the retaining plate and the baskets so that the latter will self-adjust relative to the tube sheet and adjacent heat exchanger tubes. In another embodiment, the compressible means is disposed between the retaining plate and its peripheral mount adjacent the housing head so that the retaining plate also will self-adjust. In a further embodiment, the compressible means is disposed between the retaining plate and the tube sheet to provide an additional self-adjustment for the plate. Various combinations of the said embodiments are possible. Furthermore, various types of compressible means may be utilized.

BRIEF DESCRIPTION OF THE DRAWINGS

The accompanying drawings illustrate the best mode presently contemplated by the inventor for carrying out the invention.

In the drawings:

FIG. 1 is a schematic showing of a heat exchanger and fluid flow controls therefor;

FIG. 2 is a fragmentary perspective view of a portion of the heat exchanger interior and showing the tube sheet and retaining plate;

FIG. 3 is a fragmentary view of one form of the device, with parts broken away and in section, and showing the results of a misaligned tube sheet;

FIG. 6 is a section taken on line 6—6 of FIG. 5;

DESCRIPTION OF THE PREFERRED EMBODIMENTS

Figure 4:
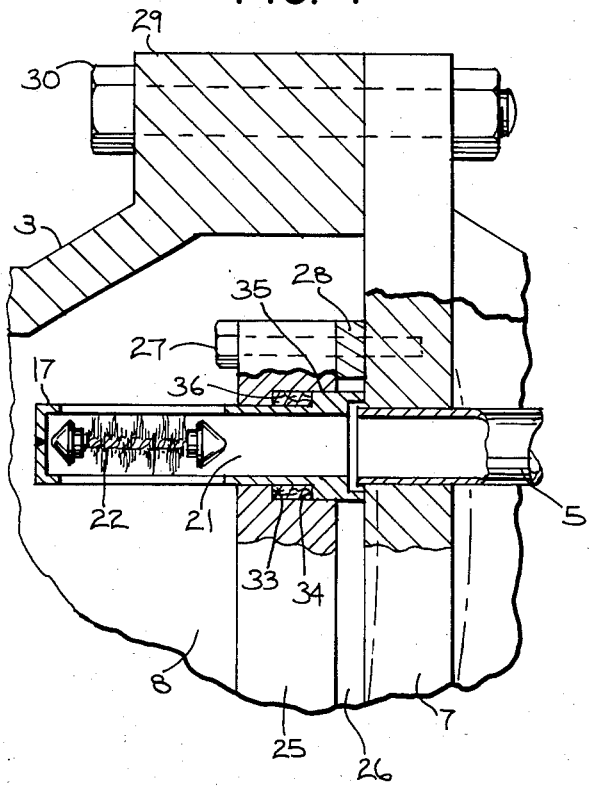
FIG. 4 is a view similar to FIG. 3 and showing one form of tube sheet misalignment correction.

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to circular transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, the ends of each tube 5 are connected to a capturing device which in the present embodiment comprises a longitudinally extending elongated slotted basket 17 which is coaxial with the tube and made of metal or other suitable material. The basket is slotted at 18. The outer end of each basket 17 is provided with a pair of narrow tabs 19 which are folded over and joined, as by a weld 20, to form an abutment.

Each basket forms a capturing chamber 21 for holding a tube cleaning device 22 which is adapted to shuttle back and forth between end baskets within its respective tube 5 upon reversal of fluid flow by valve 16. Device 22 may be of any desired well known type.

For purposes of convenience, the structure shown in FIGS. 2–8 relates to the left end of the heat exchanger 1 of FIG. 1, but it is of course contemplated that similar structures, in reverse, would be disposed at the right end of the exchanger.

In all of the present embodiments, tubes 5 are shown as extending through tube sheets 7 so that they terminate beyond the outer tube sheet face, as at 23. Likewise, baskets 17 extend inwardly so that their inner ends 24 telescope with terminus tube portions 23. See for example, FIG. 4. In the present instance, portions 24 are adapted to telescope over portions 23, with the portions in press fit sealing relationship. (The drawings, such as FIG. 4, show portions 23 and 24 loosely fit merely to illustrate tolerances, which are exaggerated).

Referring to FIGS. 2 and 3, a retaining plate 25 is disposed longitudinally outwardly of and parallel to tube sheet 7, forming a space 26 therebetween. The diameter of retaining plate 25 is less than that of tube sheet 7. Plate 25 is fixedly secured to tube sheet 7, as by bolts 27, and an annular spacing ring 28 is disposed between the elements. Furthermore, the outer peripheral portion of tube sheet 7 is secured to an outwardly flanged peripheral portion 29 of head 3, as by bolts 30. Likewise, baskets 17 pass through retaining plate 25 and are adjustably held in longitudinal position by a threaded connection 31, so that basket inner end portions 24 extend inwardly from plate 25 toward the respective tube sheet 7.

If tube sheet 7 was perfectly planular, as it is normally designed to be, basket end portions 24 would press fittingly telescope over the respective tube end portions 23. However, as shown in FIG. 3, tube sheet 7 has become distorted and misaligned relative to the other elements, due to such factors as the heat of welding the tube sheet edges to the heat exchanger housing 2. The result is, in the illustrated example, a pulling away of tube sheet 7 from plate 25 and the forming of a curved concave surface 32 in space 26. Thus, the ends 23 of tubes 5 are disposed so that the ends 24 of baskets 17 cannot sealingly engage therewith and fluid leaks therebetween as shown by the arrows.

If surface 32 was convex rather than concave, retaining plate 25 might not seat properly parallel to tube sheet 7, also resulting in a lack of sealing of the adjacent parts.

FIG. 4 illustrates one form of construction to correct for the aforementioned misalignment. The construction is generally similar to that shown in FIG. 3, except that a longitudinally compressible means is disposed between baskets 17 and retaining plates 25. Instead of a threaded connection, such as 31, between these elements, the inner face of retaining plate 25 is provided with a plurality of recesses 33 and the inner end portions of baskets 17 are stepped to provide radially outwardly extending shoulders 34 which terminate in annular flanges 35 which are slideable in recesses 33, within very close tolerances. An annular washerlike compressible resilient gasket 36 is disposed between shoulders 34 and the bottom of recesses 33. The designed dimensions are such that if tube sheet 7 is not distorted, gaskets 36 will be slightly compressed when baskets 17 and tubes 5 telescope. However, if tube sheet 7 should be distorted, as shown in phantom in FIG. 4, gaskets 36 will cause baskets 17 to shift longitudinally into proper position relative to tubes 5.

FIGS. 5–8 show a slightly different construction wherein the peripheral portion 29 of head 3 is separated from the outer periphery of tube sheet 7, as by an annular ring 37 which is sandwiched between the elements with the assembly being held together by bolts 30. The inner peripheral portion of ring 37 is stepped, thereby providing outer and inner longitudinal surfaces 38 and 39 respectively which are joined by a transverse surface 40. In addition, in this instance retaining plate 25 is not fixedly secured to tube sheet 7 but is adapted to shift longitudinally, between sheet 7 and head 3. For this purpose, the outer edge portion of retaining plate 25 is also stepped and in a manner to compliment the stepped portion of ring 37, as by outer and inner longitudinal surfaces 41 and 42 respectively which are joined by transverse surface 43. The construction is such that plate surfaces 41 and 42 are in close engagement with ring surfaces 38 and 39 respectively for relative sliding movement thereon, with surfaces 43 and 40 in spaced facing relationship. A recess 44 between the surfaces is thus provided within which is disposed a longitudinally compressible means.

Figure 5:
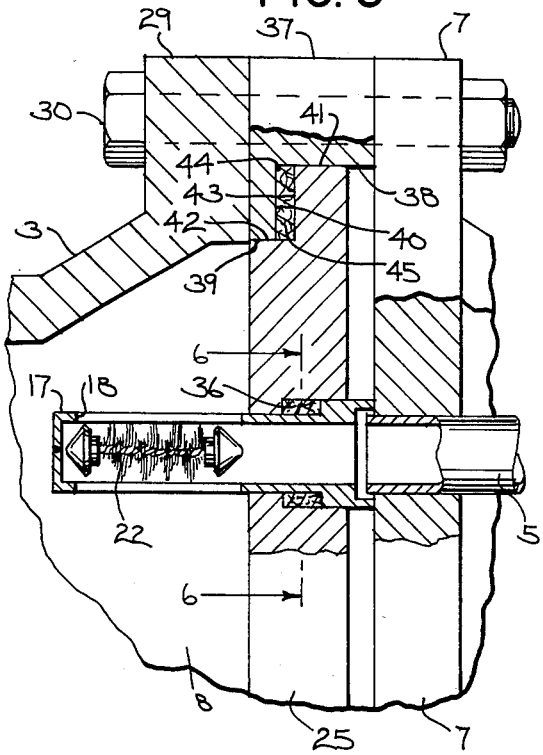
FIG. 5 is a fragmentary view of a slightly different device and showing another form of correction.

In the embodiment in FIG. 5, the longitudinally compressible means, which is basically disposed between plate 25 and head 3, comprises an annular gasket 45 which extends around the periphery of the heat exchanger. It is contemplated that gasket 45 may provide the only misalignment correction, but FIG. 5 also includes, as a supplement, a construction similar to FIG. 4 utilizing a gasket 36 between baskets 17 and plate 25. In such a dual gasket construction, both baskets 17 and plate 25 are individually shiftable longitudinally relative to each other with shiftable baskets 17 being carried by shiftable plate 25. Longitudinally outward movement of plate 25 increases the compressive forces via gasket 45 and decreases the compressive forces via gasket 36 to provide a generally balanced force correlation. This balance also occurs upon longitudinal inward movement of plate 25.

Figure 7:
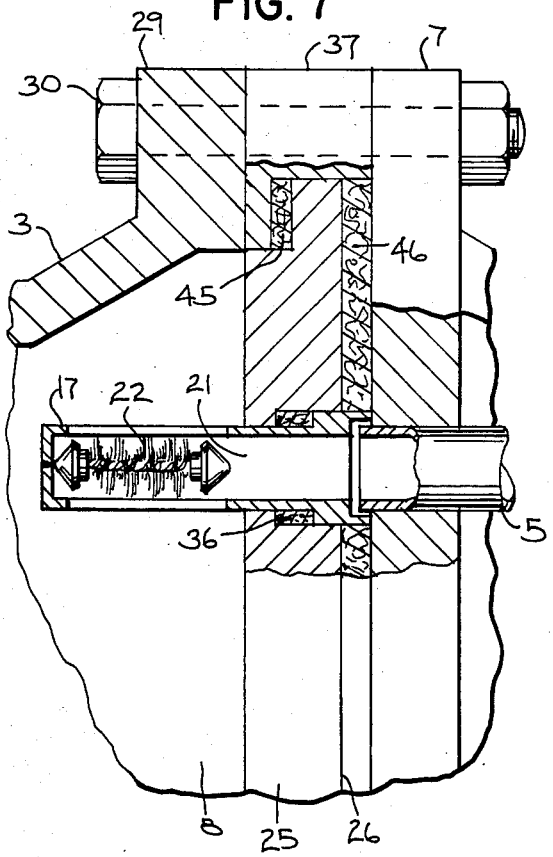
FIG. 7 is a view generally similar to FIG. 5 and showing yet another form of correction.

FIG. 7 is generally similar to FIG. 5, but adds a further longitudinally compressive means (which could in some instances operate without the other compressive means). As shown, a disk-like gasket 46 is disposed throughout space 26 between tube sheet 7 and plate 25 and has suitable openings in the vicinity of each tube-basket assembly. Gasket 46 is normally under compression, as shown, and will expand or contract depending upon any distortion of tube sheet 7.

Figure 8:
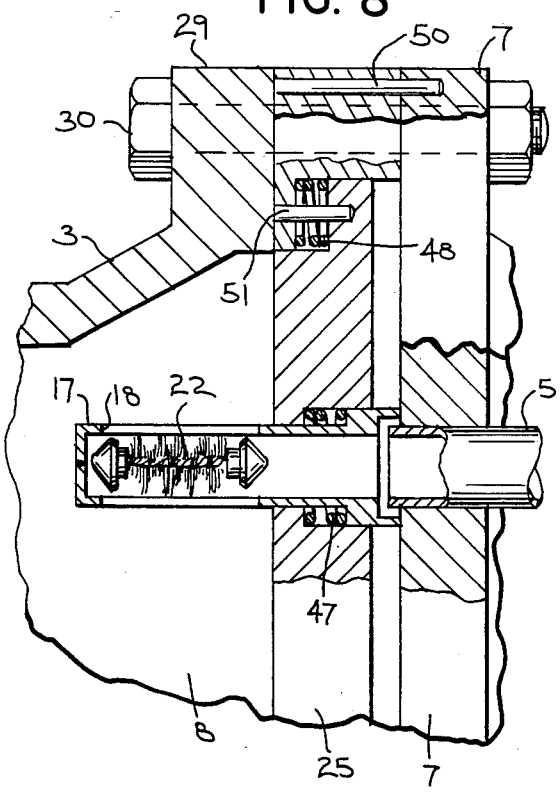
FIG. 8 is a view generally similar to FIG. 5 and showing a further form of correction.

Other compressive resilient means may be utilized besides a gasket as such without departing from the spirit of the invention. FIG. 8 illustrates the use of resilient springs 47, 48 in place of gaskets 36, 45. In this embodiment, as can also be the case with others, locating pins 50, 51 may extend from head 3 into suitable recesses in tube sheet 7 and retaining plate 25 to assist in assembling and centering the elements Note that pin 51 is centered relative to spring 48 in FIG. 8.

Various modes of carrying out the invention are contemplated as being within the scope of the following claims particularly pointing out and distinctly claiming the subject matter which is regarded as to the invention.

I claim:

1. In combination in a heat exchanger having a hosing (2) with end head elements (3, 4), and having a plurality of longitudinally extending fluid flow tubes (5) disposed within said housing, and having tube sheet elements (6, 7) disposed within said housing and with said tube sheet elements having openings in communication with the ends of said tubes, and further having longitudinally extending basket elements (17) positioned for receiving shuttling tube cleaning devices (22) from said tubes:

(a) a retaining late (25) disposed longitudinally outwardly of and generally parallel to a said tube sheet element (7) and with said basket elements (17) extending through said retaining plate (25) and being mounted for free sliding movement relative thereto in operative position, (b) and longitudinally compressible means (36, 45–48) disposed between said retaining plate (25) and at least one of said elements (17, 3, 7) to compensate for misalignment of a said tube sheet element (7) relative to the heat exchanger housing by individually positioning said basket elements (17) in proper sealing relationship with said tube sheet elements (6, 7).

2. The combination of claim 1 in which said longitudinally compressible means (36, 47) is disposed between said retaining plate (25) and said basket elements (17).

3. The combination of claim 2 in which said retaining plate (25) is fixedly secured to said tube sheet element (7).

4. The combination of claim 1 in which said longitudinally compressible means (45, 48) is disposed between said retaining plate (25) and said end head element (3).

5. The combination of claim 4 in which said retaining plate (25) is longitudinally movable relative to said tube sheet element (7).

6. The combination of claim 1 in which said longitudinally compressible means (46) is disposed between said retaining plate (25) and said tube sheet element (7).

7. The combination of claim 1 in which:

(a) a first longitudinally compressible means (36, 47) is disposed between said retaining plate (25) and said basket elements (17), (b) and a second longitudinally compressible means (45, 48) is disposed between said retaining plate (25) and said end head element (3).

8. The combination of claim 7 in which:

(a) said basket elements (17) are carried by said retaining plate (25), (b) and said basket elements (17) and said retaining plate (25) are individually shiftable longitudinally relative to each other.

9. The combination of claim 7 which includes a third longitudinally compressible means (46) disposed between said retaining plate (25) and said tube sheet element (7).

* * * * *